United States Patent [19]

Watanabe et al.

[11] 4,268,943

[45] May 26, 1981

[54] ELASTIC ROLLER FOR IMAGE FORMING

[75] Inventors: Tsuyoshi Watanabe, Kawasaki; Hidetoshi Murase; Akira Murayama, both of Yokohama; Mikio Nakasugi, Tokyo, all of Japan

[73] Assignee: Canon Kabushiki Kaisha, Tokyo, Japan

[21] Appl. No.: 55,559

[22] Filed: Jul. 9, 1979

[30] Foreign Application Priority Data

Jul. 26, 1978 [JP] Japan ..... 53-91046

[51] Int. Cl.[3] ..... B21B 27/02; G03G 15/06

[52] U.S. Cl. ..... 29/131; 118/651

[58] Field of Search ..... 29/131, 129.5, 119, 29/121.2, 121.3, 132; 15/230.11, 244 A; 118/651, 652, 661

[56] References Cited

U.S. PATENT DOCUMENTS 3,588,264 6/1971 Mallindine ..... 15/230.11 X 3,710,470 1/1973 Krake ..... 29/131

3,941,635 3/1976 Tavelle et al. ..... 29/132 X

*Primary Examiner*—Peter P. Nerbun

*Attorney, Agent, or Firm*—Fitzpatrick, Cella, Harper & Scinto

[57] ABSTRACT

An elastic roller composed of an axial core member and an elastic, liquid retentive layer of foam structure with uniform layer thickness surrounding the circumference of said core member, said elastic roller further comprising a flexible, liquid permeable member in a form of cylinder or sleeve having an inner diameter smaller than the outer diameter of said roller, said flexible member being disposed to cover the circumference of said roller and having extensions extending beyond the both side ends of said roller and being shrunk along the ends of said elastic foam structure layer at the both sides respectively so as to cover also said both side ends of the layer with said flexible member. A method of making the elastic roller is also disclosed.

9 Claims, 7 Drawing Figures

IMPROVED ELASTIC ROLLER FOR IMAGE FORMING

BACKGROUND OF THE INVENTION

1. Field of the Invention

The present invention relates to an elastic roller adapted for image forming apparatus such as electrophotographic copying apparatus and particularly suitale for use in liquid developing part or liquid cleaning part in an image forming process.

More particularly, the present invention is directed to improvements in such elastic roller and also to a method of making the improved elastic roller.

In image forming apparatus, for example, in an electrophotgraphic copying machine of the type in which liquid developer is used, there are conventionally provided elastic rollers for such stations of developing, liquid squeezing, cleaning etc. As one of elastic rollers developed for this purpose, Japanese Patent Application Laid Open No. 55644/1977 has already disclosed such type of elastic roller in which the spongy layer retentive of liquid of an elastic roller is covered by an additional flexible member of liquid permeability such as network member. When such elastic roller is rotated while contacting with a surface of rigid member such as photosensitive member or insulting member, a desired nip can be provided therebetween and liquid can be squeezed out from the liquid retentive layer of the roller or absorbed into the layer depending upon the elastic deformation of the roller. It is acknowledged in the art that such type of elastic rollers can be used advantageously in developing station, liquid squeezing part and cleaning station of electrophotographic copying apparatus.

2. Description of the Prior Art

While the above mentioned type of elastic roller according to the prior art as disclosed in Japanese Patent Application Laid Open No. 55644/1977 has various advantages, it involves a problem in assembling and manufacturing thereof.

As described above, the known elastic roller comprises an additional outer layer of network such as wire net provided on the circumference of the inner liquid retentive spongy layer of the roller. In assembling the outer network layer on the inner spongy layer there arises a difficulty to establish a close and uniform contact between the outer and inner layers without any irregularity of covering. This is attainable only by employing an extremely high standard of technique. In particular, when such elastic roller is to be incorporated into an electrophotographic copying machine, it is essential to lay the outer layer on the inner layer uniformly and tightly. Otherwise, a crease may be formed on the outer circumferential surface of the roller. In fact, hitherto, such troubles have been often observed in the copying machine that during operation and when the roller is brought into contact with the surface of a rigid member, that the elastic roller gets creased at its outer layer, that is, in the network. Also, it has been found that the development of creases in the elastic roller during operation is most remarkable at the end portions of the roller.

Treatment of end portions of the outer layer network at the both edges of the roller is also very important for performance and durability of the roller. If the end portions of the network are remained exposed at the both edges of the elastic roller, then the network becomes frayed gradually starting from the end portions during operation. After once frayed, the elastic roller no longer functions properly and there is caused irregularity along the length of the roller in liquid squeezing and absorbing action.

The above mentioned problems of creasing on the roller surface and irregularity of roller action along the length of the elastic roller may be partly attributable to the different in flexibility or hardness between the outer and inner layers. At all events, use of the elastic roller having such defects will bring forth various troubles in making copies. When such an elastic roller is used in the developing step, irregularity of developing performance may be caused by creases formed on the roller surface and by the irregularity of liquid squeezing and absorbing action along the roller length. If the roller is used to remove any excess of liquid developer, also irregularity of squeezed developer may be caused. When used as a cleaning roller, no uniform cleaning can be expected with such elastic roller and in the next step of electric charging also irregularity of charge may be caused thereby.

In addition to the above problems, the known elastic roller has another important problem. This problem is that during a long use of the roller the end portions of the roller become tapered towards the outside and liquid developer unnecessarily flows along the tapered end portions to the surface of a member with which the roller is in contact under pressure, for example, to the surface of photosensitive drum. This unfavourable flow of liquid developer onto the drum surface along the tapered end portions of the elastic roller makes dirty the visualized or developed images and in the worst case makes dirty also transfer sheets finally.

Until now, there has not yet been proposed any effective solution to the above mentioned problems involved in the known elastic roller.

SUMMARY OF THE INVENTION

Accordingly, it is the primary object of the present invention to eliminate the above described problems involved in known elastic rollers adapted for image forming apparatus such as an electrophotographic copying machine.

It is still more specific object of the present invention to provide an elastic roller which has a better performance and a broader versatility of application while eliminating the above mentioned problems involved in known elastic rollers and to provide also a method of making such improved elastic roller.

It is another object of the invention to provide an elastic roller which allows to maintain the contact pressure at the nip area uniform and constant all over the length of the roller including the both end portions thereof and which allows for liquid to adequately move in and move from (absorption and squeezing) through the contact surface while maintaining the flexibility of at least the surface layer of the roller.

It is a further object of the invention to provide a novel method of making such improved elastic roller which enables to assemble the components into an elastic roller with higher accuracy and reliability.

It is a still further object of the invention to provide an elastic roller which never forms and develops crease in its surface layer even when there is some difference in peripheral speed or in the direction of rotation between the elastic roller and the rigid partner member or even when there is some irregularity in contact pressure between the two members.

it is also an object off the present invention to provide an elastic roller which is easy to assemble and simple in structure and which is excellent in function and performance.

According to an aspect of the present invention, there is provided an elastic roller composed of an axial core member and an elastic, liquid retentive layer of foam structure with uniform layer thickness surrounding the circumference of said core member, said elastic roller further comprising a flexible, liquid permeable member in a form of cylinder or sleeve having an inner diameter smaller than the outer diameter of said roller, said flexible member being disposed to cover the circumference of said roller and having extensions extending beyond the both side ends of said roller and being shrunk along the ends of said elastic foam structure layer at the both sides respectively so as to cover also said both side ends of the layer with said flexible member.

According to another aspect of the present invention, there is provided a method of making an elastic roller comprising the steps of forming a roller body by overlaying an axial core member with an elastic, liquid retentive layer of foam structure having substantially uniform thickness surrounding the circumference of said core member: inserting the formed roller body into a sleeve of liquid permeable, flexible member having a total length larger than axial length of said roller body and having an inner diameter smaller than the outer diameter of said roller body; shrinking said sleeve at its portions extending beyond the both side ends of the inserted roller body along the both ends of said roller body while heating said portions; and holding back the free ends of said shrunk sleeve into a hollow room of said core member and securing said free ends onto the wall of said core member by pressure.

Other and further objects, features and advantages of the invention will appear more fully from the following description taken in connection with the accompanying drawings.

DESCRIPTION OF THE PREFERRED EMBODIMENTS

Figure 1:
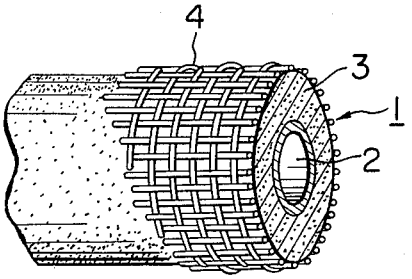
FIGS. 1 and 2 are illustrative views of components for an elastic roller pertinent to the present invention.
Figure 2:
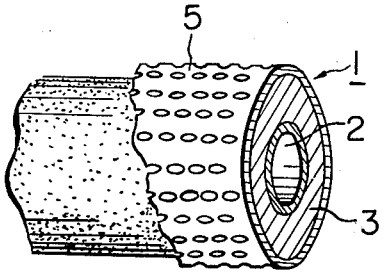

Referring first to FIGS. 1 and 2, essential members constituting an elastic roller according to the invention will be described in detail for a better understanding of the invention.

The elastic roller to which the present invention relates comprises three essential members, that is, a core member serving as a support, a porous and elastic member surrounding the core member and a flexible member having a plurality of openings through the member, said flexible member being laid on the elastic member to form the outermost layer of the elastic roller.

In FIG. 1, the core member is designated by 2, the elastic member by 3 and the flexible member by 4. These three members constitute an elastic roller 1. The core member 2 serving as a support is made from rigid material such as metal or hard sythetic resin. The elastic member 3 is of foam structure such as that of polyurethane foam. The flexible member 4 covering the elastic member 3 is a network. The elastic member of foam structure 3 is mounted fixedly on the core member 2 and the flexible network member 4 is secured to the elastic member 3 by means of restoring force from elastic deformation of the elastic foam member 3 so that the members 3 and 4 may be rotated together with the axial core member 2.

Since the elastic foam member 3 has a plurality pores or open cells which are in communication to each other and elastically deformable, the elastic member is able to absorb in and squeeze out liquid depending on its own elastic deformation. The flexible network member 4 may be of natural fiber or synthetic fiber. The network member allows liquid to flow in and out from the foam structure member 3 through the openings of the network 3. Thus, when the elastic roller impregnated with liquid is compressed, the liquid is squeezed out from the foam member 3 to the outside of the roller 1 through the network 4. When the roller is released from compression force and the foam structure member 3 is restored to its original state, liquid present in the vicinity of the surface of the network 4 is absorbed into the foam member 3 through the openings of the network.

The mesh of the outmost network member 4 shown in FIG. 1 may vary in a wide range. For the elastic roller 1 used as a developing roller in electrophotographic copying apparatus, the mesh is preferably in a range of from 100 to 300. Considering various factors such as liquid retentivity, mechanical strength and chemical stability against liquid developer, it is preferable to use, as the network 4, those fabrics made by weaving monofilament yarn of polyamide, polyester, polypropylene, polyether, polyvinyl chloride, polyacrylonitrile and polyvinyl alcohol. While the network structure of plain weave is particularly preferable, other network structure such as that of twilled fabric or fabric in satin weave is also useful. Those structures as obtained by deforming the above networks by pressure also may be used. Then the network member 4 is laid on the foam structure member 3, it is advisable that the weft of the network is disposed in parallel with the rotation axis of the elastic roller 1 as shown in FIG. 1.

Within the scope of the present invention, the structure of elastic roller can be modified variously. For example, the flexible, liquid permeable member which constitutes the outermost circumference of the elastic roller according to the present invention is never limited only to a network as shown in FIG. 1. The requirements which the flexible member must satisfy are only to have openings through which a sufficient communication can be assured between the inside and outside of the elastic roller; to have flesibility in a direction normal to the surface which is contacted by a surface of another rigid member and to have no possibility of the openings in the contact surface area being closed by contact between the two members.

FIG. 2 shows another form of the flexible member useful for the invention.

In FIG. 2, the flexible member designated by 5 is a sleeve of resin film having a plurality of openings provided therein. While the openings in the sleeve 5 is shown to be circular, they may be in rectangular, elliptical or mosaic form of combinations there of.

The elastic member of foam structure 3 is not always necessary to be in single layer as shown in FIGS. 1 and 2. The elastic member 3 may be formed as that of multilayer. The elastic member may be formed using any suitable material which has a number of communicated cells retentive of liquid therein and has a sufficient elasticity enough to absorb in and sqeeze out liquid owing to its own elastic deformation. Examples of suitable material for the elastic member 3 include foam structures of polystyrene, polyethylene, NBR (nitrile rubber), SBR, polyurethane, polyvinyl chloride and elastic members formed by natural, synthetic or metal fibers.

The axial core member 2 serves as a support for the elastic member 3 and is usually made of metal or alloy such as stainless steel and aluminum or rigid plastics such as polyoxymethylene and polyamide.

Figure 3:
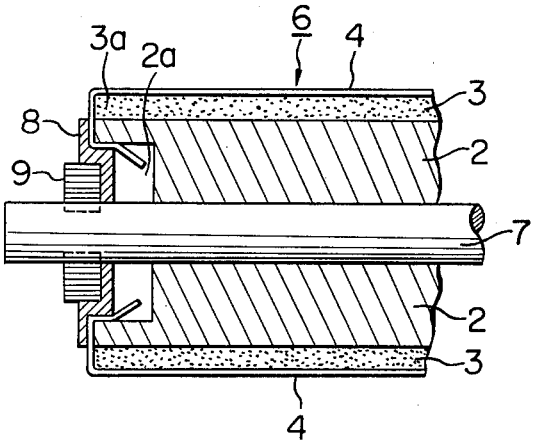
FIG. 3 is a schematic, sectional view of an embodiment of the present invention showing only one end portion of the elastic roller.

Now, improvements made in the above described type of elastic roller according to the present invention are described in detail referring to FIG. 3.

The essential feature of the present invention is found in the structure of end portions of the elastic roller. While in FIG. 3 only one end portion of the elastic roller is shown, it should be understood that the other end portion of the roller has the same structure as shown in FIG. 3. The same reference numerals as used in FIG. 1 designates members having the same functions as in FIG. 1.

The elastic roller shown in FIG. 3 comprises again a core member 2 serving as a support, an elastic foam structure member 3 with uniform thickness surrounding the core member and a network member 4 disposed on the outer circumferential surface of the elastic member.

The network member 4 has an extension extending beyond the end 3*a* of the elastic member 3. The extension if shrunk first along the side end surface including the ends of the core member 2 and the elastic member 3 so as to tightly enclose the side end surface and then the free end portion of the extension is folded back into a hollow room 2*a* provided between the core member 2 and a rotating shaft 7 of the roller.

No adhesive is applied to the contact area between the network member 4 and the member adjacent thereto such as the elastic foam layer 3 or the core member 2. The network member 4 is fastened to the end wall of the core member 2 only at the free end portions of the network member. To this end, a securing ring 8 and a fastening member 9 are used at each the end of the roller. As the securing ring 8 there may be used a molded ring of hard plastic material such as polyacetal having an adequate resiliency. The ring 8 and fastening member 9 may be bonded together into one piece member with adhesive or heat. By selecting optimum conditions for fastening the network member 4 taking into consideration the resiliency or hardness of the ring 8, flatness of the core member's end surface and friction between the ring 8 and core member 2, such trouble that the network member 4 is loosened or worn off at its end portions, can be eliminated or minimized according to the invention.

As previously mentioned, the network member 4 shown in FIG. 3 is only one example of various forms useful as a flexible, liquid permeable member serving as a top layer of the elastic roller according to the present invention. It should be understood that the present invention is never limited to this example only.

The manner of assembling for making the above elastic roller according to the present invention, in particular, the manner of processing the end portions of the roller is described hereinafter with reference to FIGS. 4 through 7 in which only one end portion of the elastic roller 6 is shown for the sake of simplification.

At the stage of assembling shown in FIG. 4, a body of elastic roller comprising the core member 2 and the elastic member 3 with uniform thickness surrounding the core member is inserted into a seamless network member 4 in a form of cylinder which is hereinafter referred to also as network sleeve 4. The inner diameter of the network sleeve 4 is somewhat smaller than the outer diameter of the roller body whereas the length of the sleeve 4 is larger than that of the core member 2. When the roller body is inserted into the network sleeve 4, the elastic foam structure 3 is slightly compressed because of its smaller outer diameter. After insertion, the network sleeve 4 extends beyond the end of the elastic member 3 by a length of the extension 4*a* at the both sides of the roller body (one side only is seen in the drawing) because of the sleeve being longer the axial length of the roller body.

Figure 4:
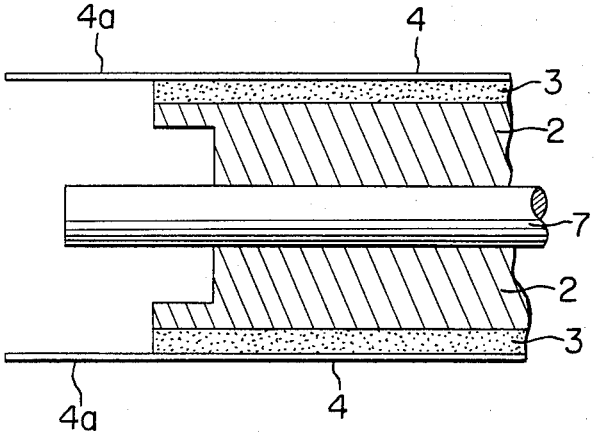
FIGS. 4 through 7 illustrate the steps of assemble for making an elastic roller according to the present invention showing only one end portion thereof in schematic sectional view.
Figure 5:
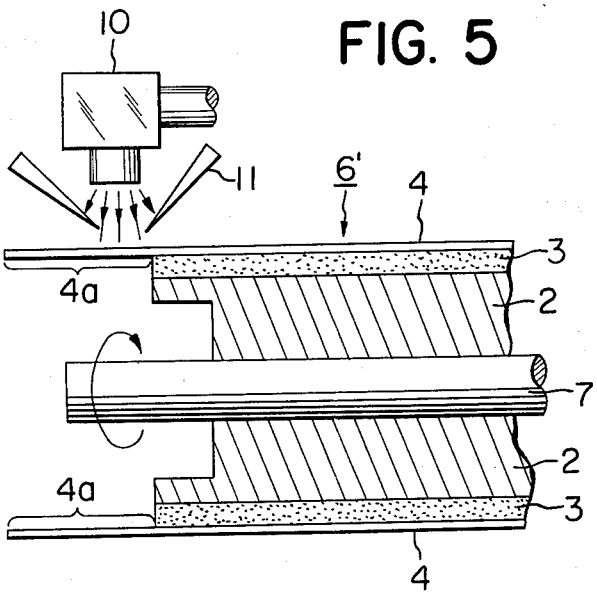
Figure 6:
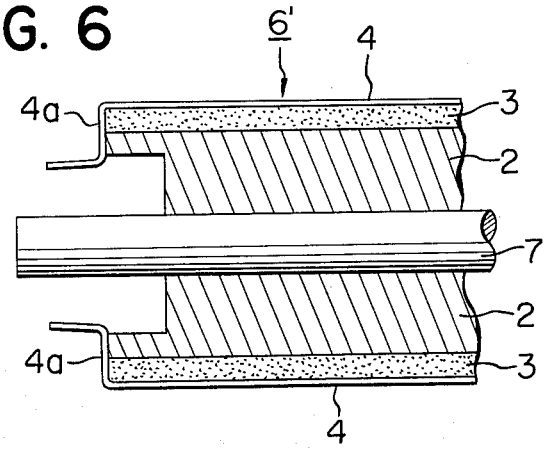

The semi-finished roller assembled at the step of FIG. 4 which is referred to as semi-finished roller 6', is then brought to the next processing step shown in FIG. 5. At this step of FIG. 5, the extension 4*a* of the network member 4 is exclusively heated up to a temperature below the melting point of the network member 4 so that a heat shrinkage of the extension may take place. More particularly, hot air is blown to the area to be heated through a slit 11 employing suitable hot air blowing means such as a dryer 10. At the time of blowing, the position of slit 11 has to be carefully selected to prevent hot air from blowing against the body of the semi-finished roller 6'. Otherwise, the elastic foam structure member 3 and/or the main part of the network member 4 other than the extension 4*a* may be deformed by heat. To assure a uniform application of heat to the network sleeve along its circumference and also to make the processing easy, the semi-finished roller 6' is rotated about its axis 7 during hot air blowing as indicated by the arrow in FIG. 5. In this step, the network sleeve 4 is shrunk along the side end surface of the roller 6' and brought into close and tight contact with the elastic foam structure 3 without any deformation of the end portion of the latter as seen in FIG. 6.

If desired, a special processing aid material may be applied to the network to be heated prior to the above heat shrinking treatment. For example, the heat treatment can be carried out advantageously in combination with such processing aid material which has an effect to prevent the network once shrunk from expanding again to its original state.

Our experiments have proved that the network sleeve 4 once subjected to the above heat shrinking treatment never suffers thereafter unfavourable deformation such as creasing and bulging.

In one experiment, there was used, as the member 4, a plain weave network of 200 mesh made of polyester fiber. In the manner shown in FIG. 5, hot air at a temperature ranging from 250° C. to 400° C. was blown against the network for about 5 to 30 seconds. The network shrank good without any development of crease. A shrinkage in the order of 5–7 mm in outer diameter was accomplished by this treatment.

In another experiment, there was used, as the member 4, a plain weave network of 180 mesh made of polyvinyl alcohol fiber. Hot air at a temperature ranging from 200° C. to 300° C. was blown against the network for 5 to 20 seconds. This treatment resulted in nearly the same shrinkage as in the above.

Figure 7:
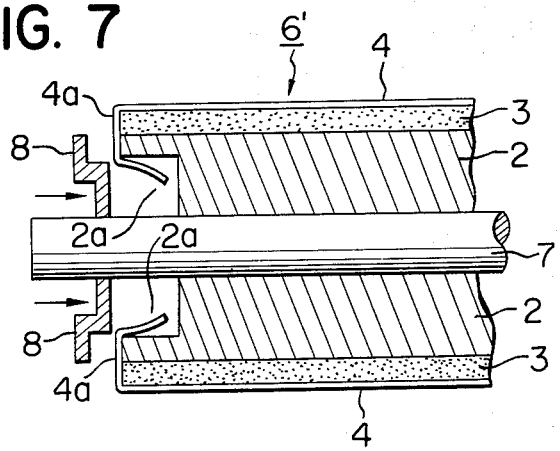

After the above heat shrinking treatment, the free end portion of the extension 4*a* of the network sleeve 4 is folded back into the space 2*a* provided between the rotary shaft 7 and the core member 2 as shown in FIG. 7. After folding, a securing ring 8 is pushed into the space along the shaft 7 to press the free end against the end of the roller 6'. Thus, the free end is fixed to the end of the roller and assembling is completed.

The elastic roller assembled in this manner according to the invention has the following advantages over the prior art ones:

1. The free ends of the network member is not exposed to the exterior at the both side ends of the elastic roller and uniformity in performance of the roller can be assured over the whole circumference of the roller.

2. Since the end portions of the network member is uniformly shrunk and secured to the end of the roller keeping a close contact between the end of the network member and the end surface of the roller body, there occurs no trouble of unfavourable deformation of the network such as creasing, bulging and twisting.

3. Number of parts required for end treatment of the network is very few and the assembling and manufacture of the elastic roller can be carried out very easily and in a simple manner.

4. Number of parts projecting beyond the ends of the roller is very few and therefore the end portions of the roller accompany no liquid during rotation which in turn eliminates trouble, for example, such trouble of the image marginal portions being made dirty by such unnecessary liquid during development.

5. The problem of tapering of the roller ends is solved and therefore there forms no flow of liquid such as liquid developer along the otherwise tapered ends of the roller. This has an effect to eliminate the trouble of transfer sheet or other member being unduly made dirty.

6. The elastic roller has an active surface extending along the full length of the roller including its both end portions. Therefore, it is allowed to design an elastic roller with necessary minimum length. This makes it possible to further miniaturize apparatus in which the elastic roller is to be incorporated.

7. Free ends of the network member and the underlying elastic foam structure member are not left exposed to the exterior at the both side ends of the roller. Therefore, these end portions are protected against damage caused by contact with rigid member or the net is not frayed. This will ensure a longer life of the roller.

The above mentioned effects 1–7 can be given only to those rollers which are manufactured according to the above manufacturing and assembling process. For other elastic rollers to which the present invention was not employed there arise various problems. In particular, the network member has an tendency to become apart from the roller body which results in many troubles as previously mentioned.

While not shown concretely in the embodiments, the elastic roller according to the present invention has many applications other than that as developing means. It may be used, for example, as liquid squeezing means, liquid flow choking means and cleaning means in image forming apparatus working with liquid. For any application, the elastic roller according to the invention can work effectively with many advantages mentioned above which the known elastic rollers according to the prior art did not have.

While the invention has been particularly shown and described with reference to preferred embodiments thereof, it will be understood by those skilled in the art that the foregoing and other changes in form and details can be made therein without departing from the spirit and scope of the invention.

What we claim is:

1. An elastic roller comprising an axial core member, and an elastic, liquid retentive layer of foam structure, having a uniform thickness, surrounding the circumference of said core member, said elastic roller further comprising a flexible, liquid permeable member in the form of a sleeve having an inner diameter smaller than the outer diameter of said roller, said flexible member being disposed to cover the circumference of said roller and having extensions extending beyond both ends of said roller and being shrunk along both ends of said elastic foam structure layer so as to cover also said both ends of the layer with said flexible member.

2. An elastic roller according to claim 1, wherein said flexible member covering is in uniform contact with said roller body along its outer circumference as well as along said ends of said roller.

3. An elastic roller according to claim 1, wherein said flexible member is made of a network structure.

4. An elastic roller according to claim 1, wherein said flexible member is formed as a molded seamless network sleeve.

5. An elastic roller according to claim 1, wherein said flexible sleeve member and said elastic foam structure layer remain unbonded at the interface therebetween.

6. An elastic roller according to claim 1, wherein said flexible member is a network of synthetic fibers in a plain weave.

7. An elastic roller according to claim 1 or 6, wherein said flexible member is heat shrinkable.

8. An elastic roller according to claim 1, wherein said core member is provided with openings at both ends thereof, and wherein both free ends of the shrunk extensions of said sleeve member are folded back into said openings of said core member and secured on the wall of said core member.

9. An elastic roller according to claim 6, said synthetic fiber is a mono-filament made of material selected from the group consisting of polyamide, polyester, polypropylene, polyether, polyvinyl chloride, polyacrylonitrile and polyvinyl alcohol.

* * * * *

UNITED STATES PATENT AND TRADEMARK OFFICE

CERTIFICATE OF CORRECTION

PATENT NO. : 4268943

DATED : May 26, 1981

INVENTOR(S) : Tsuyoshi Watanabe, Hidetoshi Murase, Akira Marayama

It is certified that error appears in the above—identified patent and that said Letters Patent is hereby corrected as shown below:

Col. 1, line 9 "suitale" should be --suitable--

Col. 1, line 27 "insulting" should be --insulating--

Col. 1, line 59 "that the" should be --the--

Col. 4, line 3 "sythetic" should be --synthetic--

Col. 4, line 57 "flesibility" should be--flexibility--

Col. 5, line 7 "sqeeze" should be --squeeze--

Signed and Sealed this

*Twenty-second* Day of *September 1981*

[SEAL]

*Attest:*

GERALD J. MOSSINGHOFF

*Attesting Officer*

*Commissioner of Patents and Trademarks*